US006241378B1

(12) United States Patent
Amberg et al.

(10) Patent No.: US 6,241,378 B1
(45) Date of Patent: Jun. 5, 2001

(54) DOSING APPARATUS FOR DETERGENT PASTE

(75) Inventors: Guenther Amberg, Neuss; Wolfgang Huber, Friedolfing; Klaus Rutz, Vaachendorf, all of (DE)

(73) Assignee: Henkel-Ecolab GmbH & Co. OHG, Duesseldorf (DE)

( * ) Notice: Subject to any disclaimer, the term of this patent is extended or adjusted under 35 U.S.C. 154(b) by 0 days.

(21) Appl. No.: 09/284,266

(22) PCT Filed: Oct. 1, 1997

(86) PCT No.: PCT/EP97/05400

§ 371 Date: May 10, 1999

§ 102(e) Date: May 10, 1999

(87) PCT Pub. No.: WO98/15682

PCT Pub. Date: Apr. 16, 1998

(30) Foreign Application Priority Data

Oct. 10, 1996 (DE) ..... 196 41 742

(51) Int. Cl.[7] ..... G05D 11/13

(52) U.S. Cl. ..... 366/152.4; 366/162.1; 366/162.4; 366/162.5; 366/173.1; 366/182.1; 366/335

(58) Field of Search ..... 366/132, 152.2, 366/152.4, 162.1, 162.4, 162.5, 173.1, 176.2, 176.3, 176.4, 182.1, 267, 268, 335

(56) References Cited

U.S. PATENT DOCUMENTS 3,706,515 * 12/1972 Keuerleber et al. ..... 425/4 R
3,913,892 * 10/1975 Ersfeld et al. .
4,889,644 12/1989 Amberg et al. ..... 252/8.9
5,221,488 * 6/1993 Amberg et al. ..... 8/137

FOREIGN PATENT DOCUMENTS 0 229 038 7/1987 (EP) .
0 295 525 12/1988 (EP) .
2 168 726 6/1986 (GB) .

* cited by examiner

*Primary Examiner*—John Kim
*Assistant Examiner*—Michael A. Fleming
(74) *Attorney, Agent, or Firm*—Wayne C. Jaeschke; Kenneth Watov; Glenn E. J. Murphy

(57) ABSTRACT

The invention relates to a dosing apparatus for pastelike substances and mixtures thereof with a solvent by means of an injector, comprising an integrated shutoff device. The apparatus contains a detection device which detects the amount of paste according to conductimetry. The shutoff device is a dual piston valve closing an opening between the paste supply tube and an injector suction chamber as well as an opening between the solvent supply tube and an injector pre-chamber. The invention also relates to a method for dosing pastelike substances and the mixtures thereof with a solvent by means of such a device. By opening a shut-off device in a supply tube for a pressurized solvent, a dual piston valve moves against an opposing force. This releases a connection between a paste supply tube and an injection suction chamber, followed by a connection between the solvent supply tube and the injector pre-chamber. The paste is suctioned by an injector operating according to the hydraulic pump principle and mixed with released solvent. The mixture is injected into a measuring section wherein a conductimetry device measures the amount of paste dissolved in the mixture. The shut-off device is closed when the required dose of paste is obtained, whereupon the circuit which was previously in an open position is shifted in reverse order to a closed position.

14 Claims, 2 Drawing Sheets

DOSING APPARATUS FOR DETERGENT PASTE

RELATED APPLICATIONS

This Application is related to co-pending application U.S. Ser. No. 09/284,296 for "A POT WITH A FLEXIBLE STORAGE BARREL AND FOLLOW-UP PLATE", filed May 10, 1999, and U.S. Pat. No. 6,149,034 for "PASTE DISPENSER", issued Nov. 21, 2000.

BACKGROUND 1.0 Field of the Invention

This invention relates generally to viscous product dispensers, and more particularly to an apparatus and a process for dosing paste-form substances and for mixing them with a solvent by an injector with an integrated shutoff member.

2.0 Discussion of Related Art

Liquid to paste-form detergents are known in large numbers. They are generally formulated to meet domestic requirements, i.e. they are expected to be sufficiently liquid so that they can be poured out and measured/dosed without difficulty. Since, in addition, they are expected to be stable in storage over a relatively broad temperature range, the use of organic solvents and/or hydrotropic additives cannot normally be avoided. However, such additives do not contribute to the actual washing process, are comparatively expensive and, in addition, take up packaging space and transportation and storage capacity. The presence of inflammable solvents is particularly troublesome and necessitates additional safety precautions because of the relatively high consumption of detergents in laundries. As a result, detergent concentrates of the type mentioned can only be used to a limited extent, if at all, in laundries.

Accordingly, powder-form detergents are mainly used in laundries. Since the exact dosing of powder-form detergents is problematical or labor-intensive, particularly in large and extensively automated laundries, the detergents are mostly stored and dispensed in predissolved form as stock liquors, i.e. a water-based concentrate is prepared and delivered to the individual points of consumption. However, the detergents typically used in laundries contain comparatively high levels of washing alkalis which are only soluble to a limited extent in cold water and, in addition, lead to so-called salting-out effects. They promote phase separation with the result that the organic components, more especially the nonionic surfactants and soaps, separate and cream up. Accordingly, the concentrates have to be diluted relatively heavily with water and, in addition, the stock liquors have to be constantly and intensively mixed and circulated to prevent individual components being deposited in the feed lines to the points of consumption. Processes such as these require considerable investment in large mixing vessels and the associated static mixers and feeders, and also a constant supply of energy for the heating and circulation of the stock liquors.

A detergent which meets these requirements is proposed in EP 0 295 525. This detergent is a paste which imposes particular demands on handling for the purpose of dosing and mixing with water as solvent. An injector operating on the principle of the water jet pump with an integrated shutoff member is proposed in this document for dosing and mixing. A measuring arrangement based on conductivity measurements is disclosed as the dose size detector. A chemical dispenser for dosing chemical solutions of unknown concentration or variable concentration in conjunction with a detector based on conductivity measurement and a corresponding process are also described in EP 0 229 038.

The hitherto proposed solutions present difficulties for the shutoff member integrated in the injector. They are concerned either with shutting off the entry of water into the paste supply line or with shutting off the supply of paste. Hitherto, there has not been a satisfactory shutoff system which provides for controlled dosing and mixing.

3.0 Summary Of The Invention

The technical problem addressed by the present invention is to further develop a known apparatus and a process for operating this apparatus in such a way that the supplies of paste-form substances and their solvents can be separately shut off so that dosing of the mixture components in accordance with the mixing ratios possible in a simple, exact and reproducible manner and with minimal outlay.

In apparatus of the type described above, this problem has been solved by the fact that the shutoff member is a dual control piston assembly for separately closing an opening between the paste supply line and an injector suction chamber, and an opening between the solvent supply line and an injector ante-chamber. In addition, the process described above which through the opening of a solvent shutoff member in a feed line for the solvent under pressure, a dual control piston assembly moves against counteracting force and, in doing so, initially opens a connection between a paste feed line and an injector suction chamber. Thereafter, a connection between a solvent feed line and an injector ante-chamber, results in paste being taken into the injector, which operates on the principle of a water jet pump. The paste is mixed with the advancing solvent and the resulting mixture is injected into a measuring zone in which the quantity of paste dissolved in the mixture is determined by a conductivity measuring arrangement and, after a preset dose size has been reached, the solvent shutoff member is closed, after which the preceding opening sequence takes place in the reverse order for shutting off.

The dosing/dispensing arrangement according to the invention has the advantage that, through the separate shutting off of the paste and solvent feed lines, controlled dosing taking the exact mixing ratios into account is possible with simple means. It is of particular advantage if, during opening, first the paste feed line and then the solvent feed line are opened and if, during shutting off, these steps take place in reverse order. This ensures that the mixing ratios remain the same over the entire dosing time.

The arrangement of the dual control piston assembly assembly in accordance with the invention on a common piston plate, include which the solvent under pressure is designed to impinge when the dosing/dispensing system is activated, enables a very simple and effective sequential control to be inexpensively obtained. The use of a 2/2 shutoff member, i.e. a switch with only two positions, namely fully open and fully closed, has the advantage that the solvent is always under the pressure favorable to the sequential switching. In conjunction with this arrangement, the determination known per se of the dose size on the basis of a conductivity measurement affords particular advantages because, together, they provide for very precise dosing.

The design of an outlet pipe for the solvent from the space in which the piston plate is accommodated as a bypass between that space and the measuring zone represents an advantageous solution which, with minimal outlay and without significantly affecting the dosing and mixing result, enables the solvent to be removed from that space so that the dual control piston assembly can be completely closed. Other solutions for removing the solvent would require very expensive 3/2 fittings in the solvent feed line and/or expensive connections to a disposal line.

The control system proposed in one particular embodiment readily enables the sequences of the individual switching steps to be effectively controlled and monitored. The proposed process or method advantageously affords the possibility of carrying out dosing and mixing by injector and dose size determination on the basis of conductivity measurement in a form which optimally utilizes the possibilities of these units and combines them with one another in a simple manner, enabling the invention to be advantageously put into practice.

The apparatus and method according to the invention are described above all with reference to paste-form detergents and their use in washing processes after dosing and mixing. In washing processes, water is usually the preferred solvent. However, they are equally suitable for other paste-form chemicals and solvents.

BRIEF DESCRIPTION OF THE DRAWINGS

The advantages described above and other advantages are illustrated by the following description of an embodiment which is shown in the accompanying drawings, in which like items are identified by the same reference designation, wherein.

DETAILED DESCRIPTION OF THE INVENTION

Figure 1:
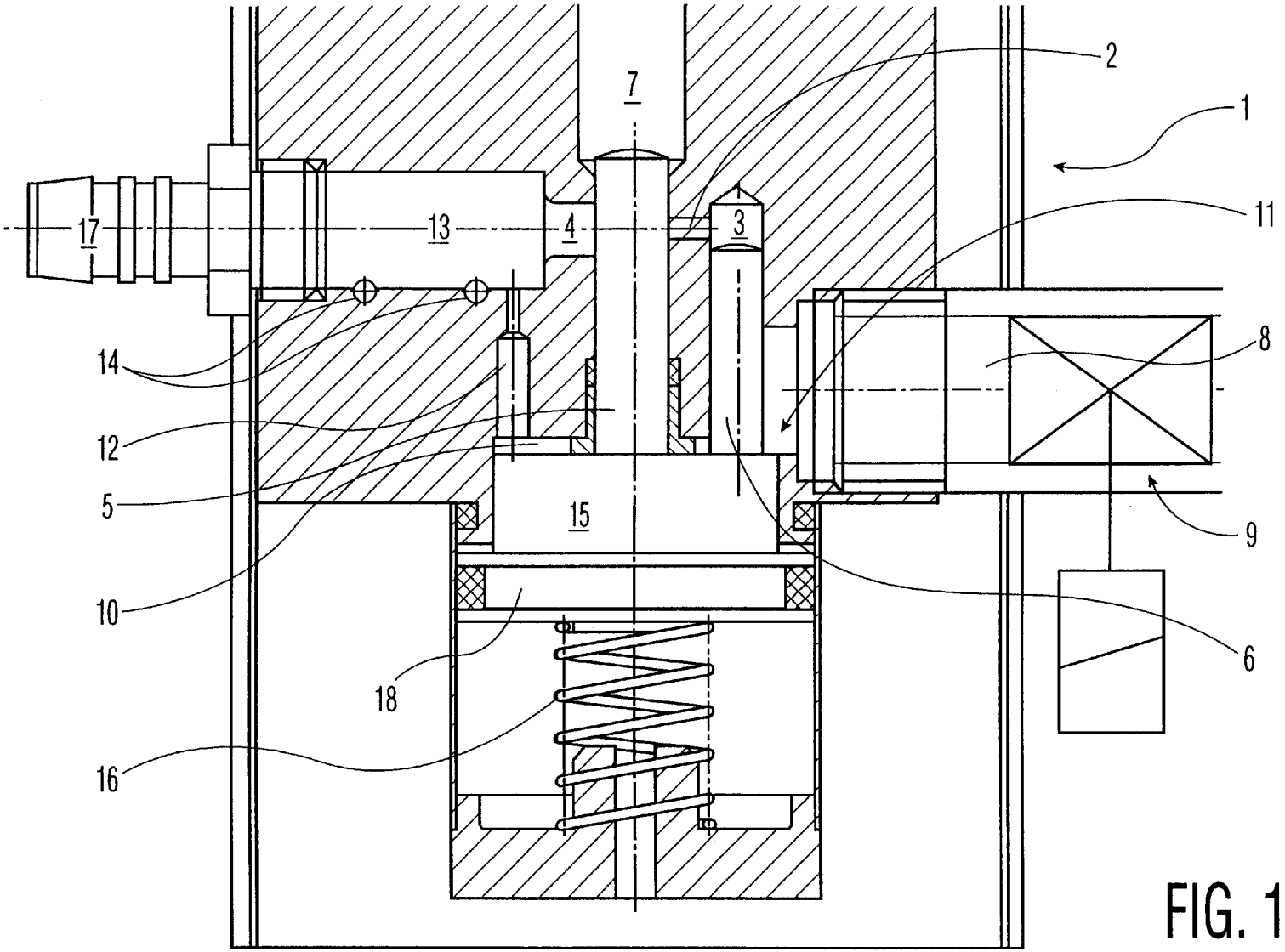
FIG. 1 shows the dual control piston assembly in a closed position.
Figure 2:
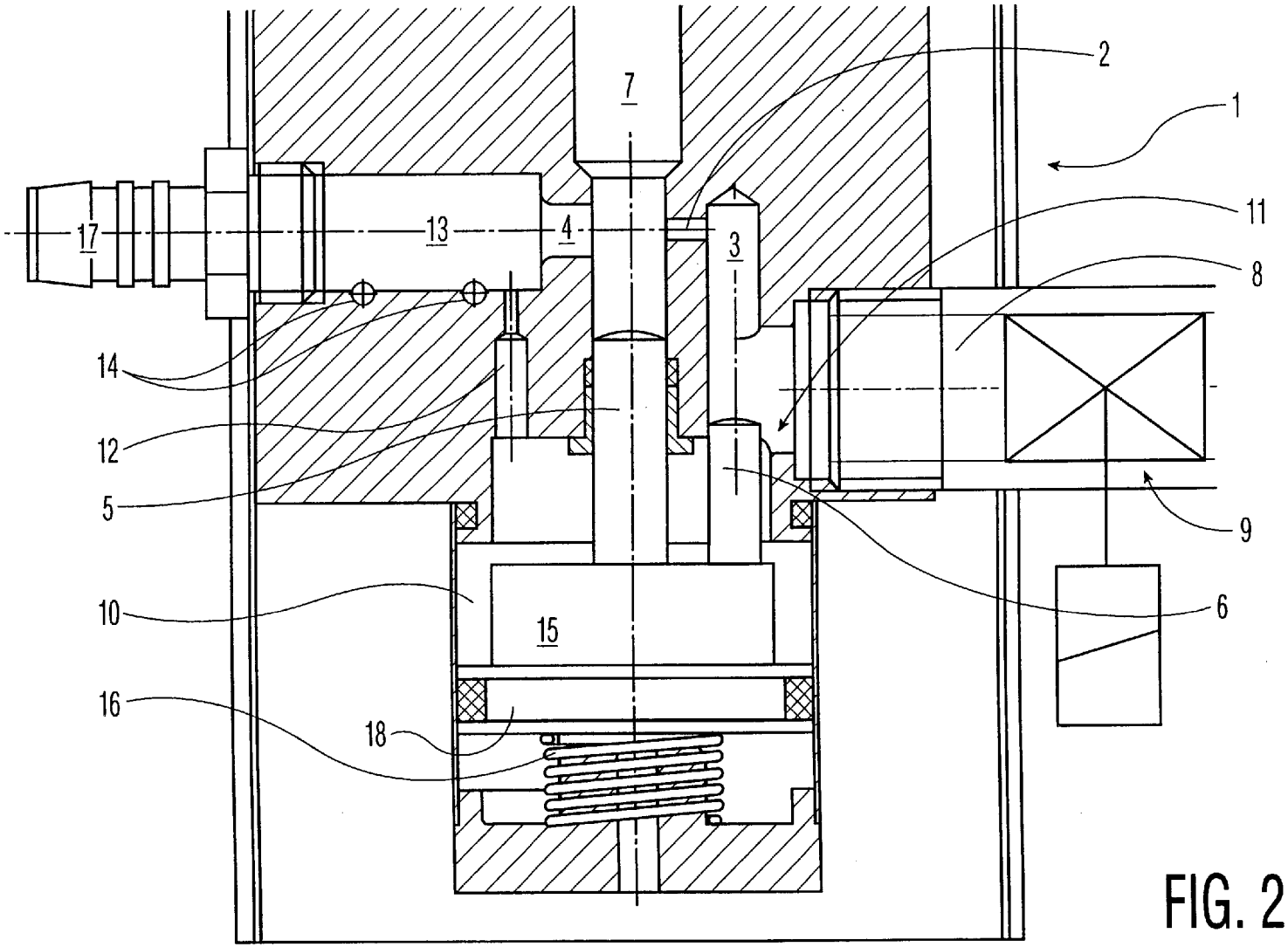
FIG. 2 shows the dual control piston assembly in an open position.

The illustration of an embodiment of the dispenser 1 shows—coming from the right—the solvent feed line 8 for the solvent which is normally water. The solvent arrives under high pressure and is separated from the dispenser 1 by the solvent shutoff member 9. A 2/2 shutoff valve or cock which only has two positions, namely fully open and filly closed, has proved to be of particular advantage for this purpose. If the solvent shutoff member 9 is open, the water under pressure impinges on the control piston 6 arranged on the piston plate 15. The piston plate 15 is arranged on a guide plate 18 which is designed for axial displacement in the cylindrical space 10. The space 10 is watertight. Arranged beneath the guide plate 18 is a spring 16 against which the guide plate 18 is axially displaceable.

The water waiting laterally under pressure beneath the injector 2 impringes on the piston plate 15 adjacent the arrangement of the piston 6 and pushes piston plate 15 downwards. In the embodiment illustrated, the spring 16 is designed in such a way that it is deflected under a water pressure of 2.5 bar. When the piston plate 15 moves downwards, it takes along the pistons 5 and 6 arranged on it. In the closed position, the piston 5 closes the connection between the paste feed line 7 and the injector suction chamber 4, while the piston 6 shuts off the connection between the feed line 8 and the injector ante-chamber 3. The length of the intervals and, accordingly, the length of the pistons 5 and 6 is selected so that, when the dual control piston assembly 5, 6, 15 descends, the connection from the paste feed line 7 to the injector suction chamber 4 is the first to be opened. As the piston plate 15 continues to descend, the connection from the solvent feed line 8, i.e. the water waiting under pressure, to the injector ante-chamber 3 is then opened by the piston 6.

By virtue of the 2/2 design of the solvent shutoff member 9, the water is immediately under full operating pressure, i.e. 2.5 bar in the illustrated embodiment, and is forced through the narrow injector nozzle 2. The injector 2 directs water through the cylinder space for the piston 5 into the injector suction chamber 4 and the co-axial measuring zone 13. The advancing water causes paste to be taken in from the paste feed line 7, whereby the paste is dissolved and mixed with the water. The resulting mixture is injected into the measuring zone 13 in which its electrical conductivity is measured by the measuring electrodes 14 arranged at intervals in the direction of flow. This measuring arrangement enables the exact amount of paste present in the mixture to be determined, so that even pastes of unknown concentration or varying concentration can be quantitatively determined with considerable precision. An integrator in a control system (not shown) determines the total dose size and, when the preset dose size is reached, gives the command to close the system. The transport of the paste mixture dissolved in water flowing through the product line 17 is then interrupted.

Not that a dosing chamber is provided in fluid communication with the past feed line 7 and solvent fluid feed line 8. The dosing chamber includes an inlet or injector suction chamber 4 through which the paste and the solvent enter, an outlet 17 through which the mixture of paste and solvent exits for dispensing, and a dose size detector including a coaxial measuring zone 13 for detecting via conductivity measurement electrodes 14 the presence of a preset dose of solvent and paste therein.

When the solvent shutoff member 9 closes the solvent feed line 8, the water under pressure is isolated from the apparatus. The piston plate 15 is thus moved upwards by the spring 16 via its guide plate 18. At the same time, the pistons 5 and 6 move into their cylindrical displacement spaces, first the connection from the solvent feed line 8 to the injector ante-chamber 3 and then connection from the paste feed line 7 to the injector suction chamber 4 being closed. The water displaced into the injector 2 through the positioning of piston 6 for the injector antechamber 3 dissolves the paste still present and mixes with any wastewater flowing off through the bypass 12. Since the space 10 is watertight, the guide plate 18 with the piston plate 15 arranged thereon and the pistons 5 and 6 can only be moved upwards after closure of the opening to the injector ante-chamber 3 when the water still present in the space 10 can be removed via the bypass 12. The amount of water flowing through the bypass 12 after closure of the connection to the injector ante-chamber 3 is so small that it does not significantly affect the mixing ratio.

Although various embodiments of the invention have been shown and described, they are not meant to be limiting. Those of skill in the art may recognize certain modifications to these embodiments, which modification are meant to be covered by the spirit and scope of the appended claims.

What is claimed is:

1. An apparatus for dosing and mixing quantities of paste-form substances and a solvent in a preset ratio prior to dispensing, said apparatus comprising:

a paste feed line for supplying paste to said apparatus;

a solvent feed line for supplying a solvent to said apparatus, said solvent feed line including a solvent shutoff member for selectively interrupting the flow of the solvent through the solvent feed line;

a dual piston control assembly including a piston plate adapted for movement between a first position and a second position, and first and second pistons each extending from one side of said piston plate;

a dosing chamber in fluid communication with the paste and solvent fluid feed lines, said dosing chamber including an inlet through which the paste and the solvent enter, an outlet through which the mixture of paste and solvent exits for dispensing, and a dose size detector for detecting via conductivity measurement the presence of a preset dose of solvent and paste therein; and a first passage fluidly connecting the paste feed line with the inlet of the dosing chamber enabling fluid flow therebetween, and a second passage fluidly connecting the solvent feed line with the first passage configured for enabling high velocity jet-stream fluid flow therebetween, thereby inducing sufficient mixing between the paste and solvent, said first and second passages each being configured for receiving said first and second pistons, respectively, as the piston plate moves to the first position to close the corresponding fluid flows therethrough.

2. Dosing apparatus as claimed in claim 1, wherein the first position and second position occupied by the piston plate of the dual piston control assembly include a closed position and an open position, respectively.

3. Dosing apparatus as claimed in claim 2, wherein the first and second pistons and the piston plate of the dual piston control assembly, in moving from the closed position to the open position, first opens the first passage between the paste feed line and the dosing chamber, and then the second passage between the solvent feed line and the first passage and, in moving to the closed position, shuts off the corresponding first and second passages in reverse order.

4. Dosing apparatus as claimed in claim 1, further including an injector in fluid connection between the second passage and the first passage for passing a jet-like stream of solvent into the dosing chamber via the second passage.

5. Dosing apparatus as claimed in claim 4, wherein the dosing chamber further includes a dose size detector having a measuring zone with a plurality of conductivity measuring electrodes being arranged at intervals in the direction of flow, the measuring zone being arranged in such a way that it is co-axial with the injector.

6. Dosing apparatus as claimed in claim 5, wherein a discharge line for the solvent is a bypass between a sealed space containing said first and second pistons arranged on the piston plate, and the dosing chamber.

7. Dosing apparatus as claimed in claim 5, further including a control system which is designed to open the solvent shutoff member, to control the operating sequences of the dual piston control assembly, to evaluate signals from said plurality of conductively measuring electrodes, and to close the solvent shutoff member when a preset paste dose size is reached.

8. Dosing apparatus as claimed in claim 7, wherein a discharge line for the solvent is a bypass between a sealed space containing said first and second pistons arranged on the piston plate, and the dosing chamber.

9. Dosing apparatus as claimed in claim 1, wherein the dual piston control assembly further includes a spring element disposed on one side of said piston plate for normally biasing the piston plate into the first position.

10. Dosing apparatus as claimed in claim 9, wherein the first and second pistons arranged on the piston plate reside in a sealed space, the piston plate—after opening of the shutoff member in the solvent feed line—being exposed to the solvent under pressure moves against the force of the spring element to the second position, the sealed space including a connection to a discharge line for the solvent.

11. Dosing apparatus as claimed in claim 10, wherein the discharge line for the solvent is a bypass between the sealed space and the dosing chamber.

12. Dosing apparatus as claimed in claim 10, wherein the solvent shutoff member has only two states of operation, namely an open state and a closed state.

13. Dosing apparatus as claimed in claim 12, wherein the discharge line for the solvent is a bypass between the sealed space and the dosing chamber.

14. A process for dosing paste-form substances and for mixing them with a solvent, said process comprising:

deactivating a solvent shutoff member located in a pressurized solvent feed line for supplying a solvent;

moving a dual control piston assembly from a closed position to an open position in response to the pressure exerted by the supplied solvent impinging on said dual control piston assembly;

opening a first passage fluidly connecting a paste feed line for supplying a paste to a dosing chamber with an outlet for dispensing a solvent/paste mixture, as the dual control piston assembly moves to the open position;

opening a second passage fluidly connecting the solvent feed line to the first passage for directing a jet stream of the solvent into the first passage for at least substantial mixing with the supplied paste;

directing the resulting solvent/paste mixture into the dosing chamber, wherein said dosing chamber further includes a conductivity measuring apparatus;

measuring the dose size of the solvent/paste mixture by said measuring apparatus through gauging the conductivity of the solvent/paste mixture;

detecting a preset dose size of the solvent/paste mixture;

activating the solvent shutoff member for interrupting the supply of solvent; and moving the dual control piston assembly from the open position to the closed position in response to the absence of the solvent impinging on the dual control piston assembly, wherein the preceding passage opening steps takes place in reverse order for closing off the paste and solvent feed lines from the dosing chamber.

* * * * *